United States Patent [19]

Guthrie et al.

[11] Patent Number: 4,894,280

[45] Date of Patent: Jan. 16, 1990

[54] FLEXIBLE, TEAR RESISTANT COMPOSITE SHEET MATERIAL AND A METHOD FOR PRODUCING THE SAME

[75] Inventors: David W. Guthrie, Roswell; Robert E. Weber, Marietta, both of Ga.

[73] Assignee: Kimberly-Clark Corporation, Neenah, Wis.

[21] Appl. No.: 136,235

[22] Filed: Dec. 21, 1987

[51] Int. Cl.[4] ..... B32B 3/00

[52] U.S. Cl. ..... 428/224; 428/288; 428/296; 428/297; 428/903

[58] Field of Search ..... 428/224, 288, 903, 296, 428/297; 156/308.2

[56] References Cited

U.S. PATENT DOCUMENTS

| | | | |
|---|---|---|---|
| 2,399,260 | 4/1946 | Taylor | 428/903 |
| 3,016,599 | 1/1962 | Perry, Jr. | 428/903 |
| 3,620,892 | 11/1971 | Wincklhofer et al. | 161/89 |
| 3,630,818 | 12/1971 | Dobe | 161/150 |
| 3,639,195 | 2/1972 | Sanders | 156/62.2 |
| 3,704,198 | 11/1972 | Prentice | 161/148 |
| 3,916,447 | 11/1975 | Thompson | 2/46 |
| 4,041,203 | 8/1977 | Brock et al. | 428/903 |
| 4,100,324 | 7/1978 | Anderson et al. | 428/288 |
| 4,118,531 | 10/1978 | Hauser | 428/224 |
| 4,279,979 | 7/1981 | Benson et al. | 429/254 |
| 4,310,594 | 1/1982 | Yamazaki et al. | 428/296 |
| 4,315,048 | 2/1982 | Beghelli et al. | 428/78 |
| 4,426,417 | 1/1984 | Meitner et al. | 428/903 |
| 4,472,229 | 9/1984 | Martin | 156/307.1 |
| 4,474,846 | 10/1984 | Doerer et al. | 428/288 |
| 4,477,516 | 10/1984 | Sugihara et al. | 428/296 |
| 4,479,999 | 10/1984 | Buckley et al. | 428/245 |
| 4,522,863 | 6/1985 | Keck et al. | 428/196 |
| 4,555,811 | 12/1985 | Shimalla | 2/51 |
| 4,587,154 | 5/1986 | Hotchkiss et al. | 428/195 |
| 4,637,949 | 1/1987 | Manning et al. | 428/110 |

*Primary Examiner*—Paul J. Thibodeau

*Attorney, Agent, or Firm*—Patrick C. Wilson

[57] ABSTRACT

A flexible tear resistance composite sheet material is disclosed comprising a web of thermoplastic microfibers with from 35 to 80 percent by weight of staple fibers homogeneously dispersed throughout the web. The composite is subjected to a sufficient quantity of heat and pressure such that the thermoplastic microfibers at least partially melt and compact into a contiguous sheet with the intact staple fibers being dispersed therein. Located throughout the sheet are a plurality of voids which act as tear stops. The resulting material has a void volume of about 33 to about 55 percent and a machine direction slit trapezoidal tear resistance greater than or equal to 1.7 kg per 100 g/m$^2$ equivalent basis weight. Also disclosed herein is a process for making the composite sheet material.

6 Claims, 4 Drawing Sheets

POLYESTER : 30% MICROFIBER: 70% STAPLE
BASIS WEIGHT : 290 g/m$^2$

FLEXIBLE, TEAR RESISTANT COMPOSITE SHEET MATERIAL AND A METHOD FOR PRODUCING THE SAME

CROSS REFERENCE TO RELATED APPLICATION

The use of a flexible, tear resistant composite sheet material in conjunction with a scrim reinforcing material to form a low stretch composite belting material is described and claimed in copending and commonly assigned application Ser. No. 135,868, entitled LOW STRETCH, FLEXIBLE, TEAR RESISTANT COMPOSITE BELTING MATERIAL AND A METHOD FOR PRODUCING THE SAME, filed on even date in the name of David W. Guthrie now abandoned.

BACKGROUND OF THE INVENTION

The present invention relates to a flexible, tear resistant composite sheet material and a method for producing the same. More specifically, it relates to composite sheet material made from a nonwoven web of thermoplastic microfibers containing a plurality of staple fibers which are subjected to sufficient heat and pressure to at least soften the microfibers so that they can be formed into a contiguous staple reinforced sheet having certain definable properties which make the composite sheet material suitable for a number of high strength uses including abrasive backing materials, tapes, furniture fabric, interliner for clothing, geotextiles and belt material for conveyor machinery and the like.

Abrasive backing materials, adhesive tapes and geotextiles are but a few examples of materials which are formed from flexible substrates which have been further treated or converted to permit their use in high strength and tear resistant applications. Abrasive materials such as sandpaper, sanding pads and sanding belts are typically made from paper or fabric and then further treated with such materials as latexes, resins and other saturants and additives to improve their strength, tear resistance and useful life. These materials while having been greatly improved over the years, still suffer from deficiencies in overall strength and tear resistance as well as cost. Abrasive backing materials made from paper are economical to produce but suffer from the standpoint of strength, tear resistance and useful life. Fabric-backed abrasive materials provide a marked improvement over paper-based materials in the areas of strength, tear resistance and useful life, but such improvements come at the expense of significantly higher material and production costs. Furthermore, despite their improvements over paper-based products, such fabric-backed abrasive materials still lack sufficient strength and tear resistance for certain applications. As a result, there is a need for a high strength, low cost, tear resistant material.

In the areas of tapes, the needs and problems are similar to those found with abrasive backing materials. Tapes in varying applications require materials which are, among other things, flexible, waterproof, strong in the machine and cross-directions and which readily accept adhesives while being able to release from themselves. Consequently, there is a concurrent need for a high strength, tear resistant material which can be used in the construction of tapes.

Geotextile materials are permeable high-strength fabrics which are used to prevent soils from migrating into drainage systems, allow water to migrate into drainage systems, prevent erosion damage, and serve as a separator between soil and road base materials. There is a wide range of product applications and the strength requirements vary for each application. The two main properties of geotextiles are permeability and strength. The Federal Highway Administration has established physical strength categories for light, heavy, and severe product applications. The drainage and erosion product applications are in the light-heavy and heavy-severe categories, respectively. The flexible tear resistant composite sheet material of the present invention has the design capabilities to serve all three physical strength categories. This is accomplished with the high tear resistant, puncture-proof, and burst strength properties of the present invention. The ability to control the void volume enables the composite sheet material to have a range of permeabilities. Also, the range of permeabilities can be controlled by varying the staple to microfiber ratio and staple fiber diameter. The temperature stability of the sheet composite can be designed for low temperature drainage or high temperature roadway applications.

The present invention provides a material which is suitable for the above uses as well as a number of other uses or applications which require a material with similar properties. The scope of this invention should therefore not be restricted to above applications. The advantage of the present invention resides in its ability to provide a high strength, low cost, tear resistant material which is flexible, yet porous and readily accepts further treatment and/or conversion as in the case of abrasive backing material, adhesive tape and geotextile applications. In addition, the material of the present invention may be formed or molded into flexible three-dimensional shapes for nonplanar applications. These and other objects and advantages of the present invention will become more apparent from a further review of the following specification, drawings and claims.

SUMMARY OF THE INVENTION

A flexible tear resistant composite sheet material is disclosed which comprises a web of thermoplastic microfibers having an average diameter less than or equal to 10 microns with a plurality of staple fibers homogeneously dispersed throughout the web to form a composite sheet material. The staple fibers have an average length ranging from about 10 mm to about 100 mm and a denier ranging from about 3 to about 30 with the staple fibers being present in the microfibrous web in a weight ratio ranging from 80:20 to 35:65. Additionally, the staple fibers must have a melting point at least 10° C. greater than the melting point of the microfibers.

To make the material of the present invention, a molten thermoplastic polymer is extruded through a die having a plurality of small orifices to form microfibrous strands which are attenuated with air and laid down upon a forming surface. At the same time, high tenacity staple fibers are introduced into the stream of newly formed microfibers to create a homogeneous mixture of staple and microfibers in web form. To transform the web into a composite sheet material, the web is subjected to sufficient heat and pressure to cause the microfibers to melt into a sheet-like form with the staple fibers dispersed therein.

The resultant composite sheet material has a plurality of voids located on its surfaces and throughout the composite. These voids act as tear stops and must be present in sufficient quantity such that the composite sheet material has a void volume of from about 33 to 55 percent. These voids act in conjunction with the staple fibers to yield a composite sheet material with a slit trapezoidal tear resistance in the machine direction of at least 1.7 kg per 100 g/m$^2$ equivalent weight and a strip tensile strength in the machine direction of at least 4.6 kg/25 mm for a 100 g/m$^2$ basis weight equivalent material. Functional basis weights are generally in the range of 100 g/m$^2$ to 500 g/m$^2$; however, there are no upper limits for the basis weight of a composite sheet material according to the present invention.

DESCRIPTION OF THE PREFERRED EMBODIMENT

Figure 1:
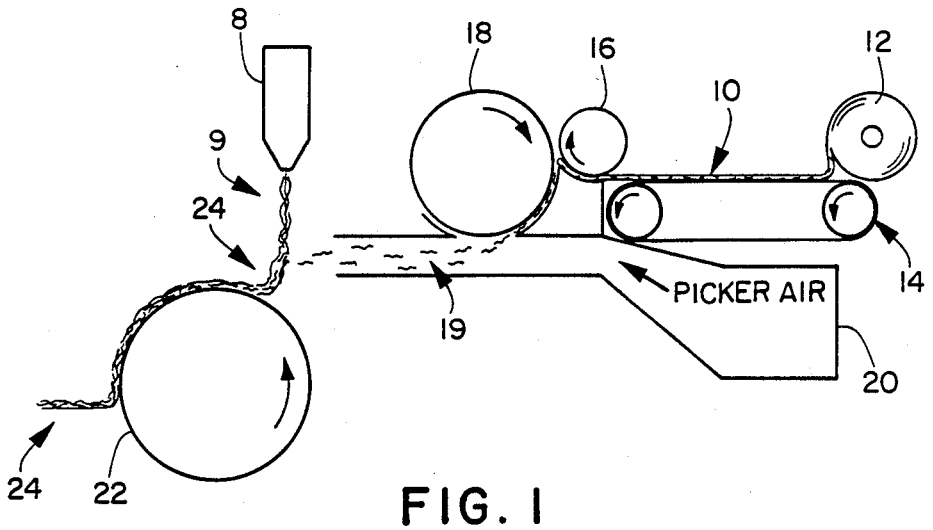
FIG. 1 is a diagrammatic view of an air laid process and apparatus for forming a homogeneous mixture of staple and microfibers in web form.

The present invention relates to a flexible tear resistance composite sheet material made from a web of thermoplastic microfibers and staple fibers which have been heated and compressed until the microfibers at least partially melt and fuse into a contiguous layer containing the staple fibers and a plurality of voids throughout the material. The resultant produce is a strong, flexible material which is very resistant to tearing. Consequently, the material has a wide variety of uses, the most notable of which include conveyor belts, geotextiles, tapes and backing material for abrasive products such as sanding paper.

Abrasive products such as sandpaper are made from a number of components which can be treated and combined in a plurality of ways. Almost all abrasive products include three basic components; a substrate or backing material, abrasive grit particles and a layer of adhesive material to bind the abrasive grit particles to the backing material.

Ideally, the backing material should be strong, flexible, tear-resistant and provide a good surface for attachment of the adhesive material and grit. To accomplish this, the material of the present invention employs a microfibrous web which contains a plurality of reinforcing staple fibers. This composite is then subjected to sufficient heat and pressure so as to cause the microfibers to melt and fuse into somewhat contiguous layer with the still intact staple fibers dispersed therein. It is believed that the advantageous properties of the present material are due in part to the processing of the composite material. This is because the material, once processed, is neither a web nor a film. Instead, it is a material which structurally is in between a web and a film and contains a prescribed percentage of voids dispersed throughout the material.

A nonwoven web, when viewed under magnification, is made up of a number of individual, discernible fibers which are randomly entangled to give the web a certain degree of integrity. The degree of integrity is due, at least in part, to the fiber composition, tenacity, fiber length, density and degree of fiber entanglement. The integrity of the web can be further enhanced through interfilament bonding which can be achieved through the use of heat, pressure, adhesives or a combination of the foregoing. As a result of the overlapping and entanglement of the fibers, the nonwoven material is very porous.

In contrast, a film is a continuous layer of material typically formed through the extrusion of a polymeric resin. Thermoplastic films such as polyethylene and ethylene vinyl acetate are two examples of extruded film materials. Films differ from nonwoven webs in a number of ways, the most notable of which being that films have fairly smooth continuous surfaces and they have little or no porosity.

The composite sheet material of the present invention lies between these two extremes. It is not a nonwoven web because the microfibers have been sufficiently melted and compressed such that they have lost essentially all of their fibrous shape. Conversely, the present material is not a film because it still contains a plurality of voids and is not totally continuous in nature as a film would be. As a result, the staple fiber reinforced material of the present invention has a strength and tear resistance that is not exhibited by either a staple fiber reinforced web or a staple fiber reinforced film.

Initially the material of the present invention is formed from a staple fiber reinforced web. The web itself is made from a plurality of extruded microfibers formed from thermoplastic materials such as polyamides, polyesters, polyurethanes, polyvinylacetates and compatible copolymers thereof. Whatever microfiber resin is chosen, it should be a resin which extrudes easily. It should also be compatible with the staple fibers used in the sense that the resin will adhere to the staple fibers once the microfibers have been heated and compressed.

Depending upon the process and equipment used, the microfibers may be continuous, noncontinuous or a combination thereof. By continuous it is meant that the fibers have an average length greater than one meter. Below this length, the fibers are regarded as noncontinuous. To aid in the formation of the finished product, the microfibers should have an average diameter less than or equal to 10 micrometers (microns).

The thermoplastic resins used to form the microfibers are available from a wide number of sources. A partial listing of available resins and their source includes the following: Eastobond® FA 300 copolyester from Eastman Chemical Products, Inc., of Kingsport, Tennessee; Dowlex$^2$ 618 polyethylene from Dow Chemical Co. of Midland, Michigan; Dynapol® S-360 copolyester from Dynamitt Noble of Rockleigh, New Jersey; Unirez® 2665 polyamide from Union Camp Corp. of Wayne, New Jersey; Escorene® Ultra polyethylene vinylacetate from Exxon of Houston, Texas; Estane® 58887 polyurethane from B. F. Goodrich Chemical Company of Cleveland, Ohio, and Valox® 315 polyester polybutyl terephalate from General Electric Co. of Pittsfield, Massachusetts.

The staple fibers are used as reinforcing within the web of the present material and have an average length ranging from about 10 mm to about 100 mm with a denier from about 3 to about 30. Materials suitable for formation of the staple fibers include nylon, polyester, rayon, acrylic, glass, cotton, and aromatic polyamides. Whatever material is chosen for the staple fiber, it should be a material which is adhesively compatible with the thermoplastic microfibers. Otherwise the staple fibers can break loose from the microfiber layer of the finished product thereby weakening the end product. Due to process considerations, it also is desirable to select a staple fiber which has a melting point at least 10° C. greater than the melting point of the microfibers. In this way, the microfibers can be melted out through the use of heat and pressure without disturbing the integrity of the staple fibers.

The materials used to form the staple fibers are available from a number of sources. A partial listing of materials and their sources includes the following: Kodel® 431 PET from Eastman Chemical Products, Inc., of Kingsport, Tennessee and Terelyene® 233 nylon from ICI Fibers of Greensboro, North Carolina.

One process for forming the composite sheet material is shown in FIG. 1 and is referred to as the staple coform process. The process involves the introduction of staple fibers into a stream of thermoplastic microfibers during their formation to form a composite which is typically referred to as staple coform.

The coform process mechanically entangles meltblown microfibers and staple fibers to form an air laid nonwoven. The microfibrous portion of the staple coform web is formed through the extrusion of a thermoplastic resin. Referring to FIG. 1, molten thermoplastic resin is extruded through a plurality of die tips within a blowing die 8. Due to the heat and pressure exerted on the molten resin within the die 8, the resin emerging from the die 8 is in the form of thin fibers 9 which may be further attenuated by optional side stream air (not shown).

Referring again to FIG. 1, the staple fibers are derived from a batt 10 of staple fibers on roll 12. The staple batt 10 in unwound from roll 12 onto conveyor 14 which transports the batt 10 to a feed roll 16 and picker roll 18. Fibers from the staple batt 10 are separated by the picker roll 18 and these staple fibers 19 are then directed into an air duct 20 containing high velocity air, called picker air, which directs the individual staple fibers 19 into the stream of meltblown fibers 9. As the staple fibers 19 enter the stream of meltblown fibers 9, the two mix together, become entangled and are subsequently laid down onto a forming drum 22 as a coform web 24. The resultant coform web 24 is comprised of the meltblown microfibers 9 with a plurality of the staple fibers 19 dispersed throughout the web. Depending upon the temperatures at which the web is formed the web may have very little or quite a lot of interfilament bonding. However, because the web will be further heated and compressed, the web only needs to have an integrity sufficient to permit the web to be removed from the forming drum 22 and further processed. For a further discussion of similar processing techniques, see U.S. Pat. No. 4,100,324 and an article entitled "Super Fine Thermoplastic Fibers" appearing in *Industrial and Engineering Chemistry,* Vol. 48, No. 8, pp. 1343–1346, both of which are incorporated herein by reference. Also see Naval Research Laboratory Report 11437, dated Apr. 15, 1954 and U.S. Pat. No. 3,676,242, both of which are incorporated herein by reference.

After the coform web 24 is formed, it is then heated and compressed to melt the microfibers and compact them into a sheet-like structure with the staple fibers remaining intact and being dispersed throughout the compacted and fused sheet. As will be readily appreciated by those skilled in the art, there are a number of ways by which the coformed web can be heated and compressed into its final state. Two such methods and apparatus are depicted in FIGS. 2 and 3.

Figure 2:
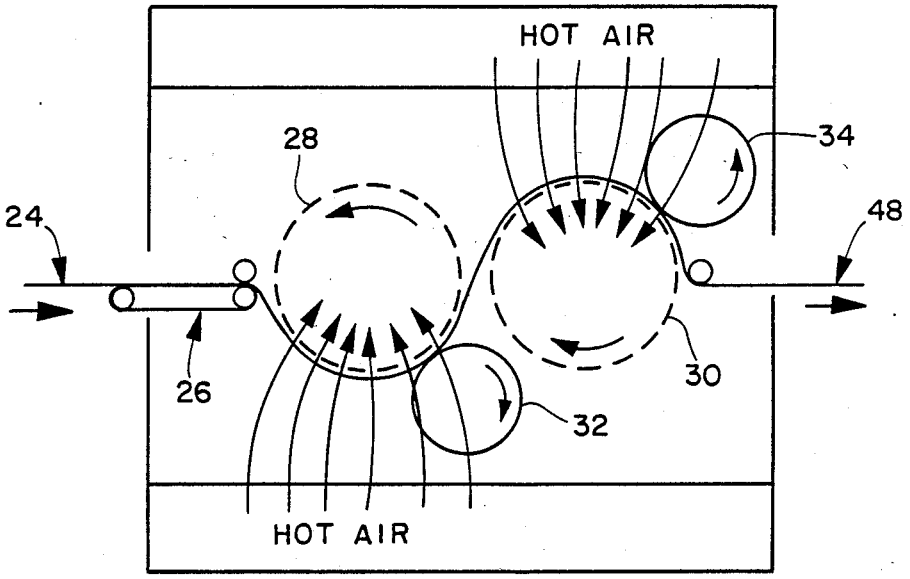
FIG. 2 is a diagrammatic view of a thermobonding process and apparatus for converting the air laid material formed through a process as is shown in FIG. 1 into a composite sheet material according to the present invention.

In FIG. 2 the coform web 24 is shown being subjected to a perforated drum-through air thermobonding process. The coform web 24 is fed via conveyor 26 to a pair of perforated drums 28 and 30 where the web is heated further by hot air which is directed onto and through the web 24 and drums 28 and 30. Depending on the melting point of the microfibers, the temperature of the hot air and the dwell time of the web on the drums 28 and 30, sufficient melting and fusion of the microfibers may or may not take place. Optionally, therefore, calendering rolls 32 and 34 may be used in conjunction with the perforated drums 28 and 30 to further compress the softened web material. In either event, however, the temperature and pressure should be adjusted so as not to degrade the staple fibers which should remain intact throughout the process. Accordingly, the staple fibers should have a melting point at least 10° C. greater than the melting point of the microfibers.

Figure 3:
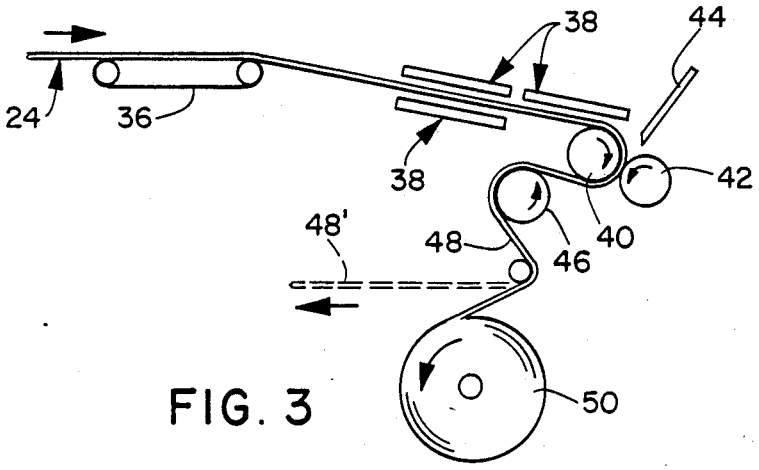
FIG. 3 is a diagrammatic view of another thermobonding process and apparatus for converting the air laid material formed through a process as is shown in FIG. 1 into a composite sheet material according to the present invention.
Figure 4:
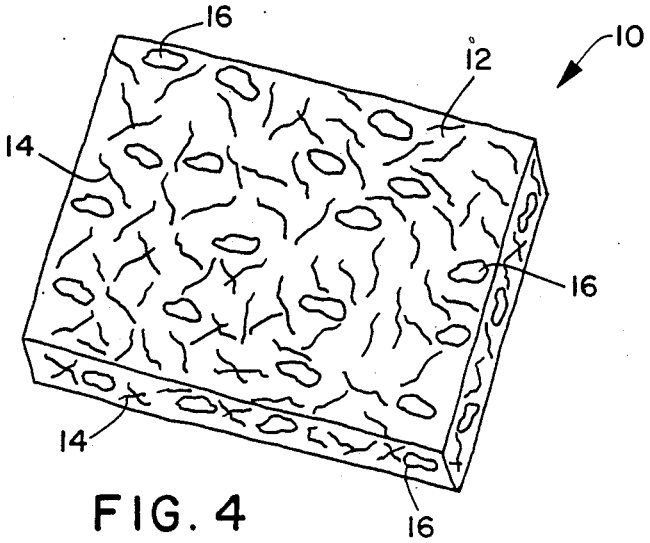
FIG. 4 is a perspective view of a composite sheet material according to the present invention.

A second means for converting the coform web into the composite sheet of the present invention is shown in FIG. 3 of the drawings. The coform web 24 is fed on conveyor 36 through a bank of infrared heaters 38 to again soften the microfibers of the web 24. The web 24 is then fed through a pair of calender rolls 40 and 42 to compress and fuse the microfibers into a sheet-like layer. To aid the process, an optional air slot heater 44 can be directed at the top of calender rolls 40 and 42 to provide additional heat to the web 24.

After the web 24 has been heated and compressed, the densified web then passes over chill roll 46 to quench the compressed molten microfiber sheet which at this point no longer resembles a nonwoven web since the microfibers have been melted and fused together. From the chill roll 46 the material, which is now referred to as a composite sheet material 48, is wound up on wind-up roll 50. Alternatively, the composite sheet material 48 can be subjected to further processing depending upon the end use and design criteria of the material.

Given the versatility of the present invention and its components it is possible to use numerous combinations of equipment and processing steps to produce the composite sheet material. Temperatures and pressures will vary depending upon the properties of the microfibers and staple fibers chosen. In any event, however, the staple fibers should have a melting point at least 10° C. higher than the melting point of the microfibers and the two components should be adhesively compatible.

In addition to the base components of microfibers and staple fibers, other constituents may be added to the coform web. For example, binders (powdered or otherwise) may be added to the web to enhance the binding and fusion of the microfibers to themselves and to the staple fibers as well. Pigments, UV stabilizers, fire retardants and other additives may also be incorporated into the web material. Furthermore, blends of different microfibers and/or staple fibers may be used to form the composite sheet material of the present invention. In the case of dispersing powdered adhesives as a binding agent for a dry layered staple fiber composite, only low basis weight webs, less than 100 g/m$^2$, can be made with uniform distribution of staple fiber and adhesive.

The surface of the composite sheet material may be varied by varying the temperature, the degree of calendering and the surface texture/pattern of the calendering rolls. When a through-air thermobonding technique is used (such as is shown in FIG. 3 without the optional calendering rolls 32 and 34), the exterior surface of the composite sheet material will have a fabric-like hand. Similar fabric-like textures can also be achieved through the use of calender rolls with embossed surfaces. In contrast, a very smooth shiny surface can be achieved by using smooth surface calender rolls. Lastly, smooth and embossed calender rolls can be used in pairs to create a composite sheet material that is smooth on one side and more fabric-like on the other.

The strength, tear-resistance and durability of the composite sheet materials of the present invention are believed to be due to the void volume of the material as well as the combination of the staple fibers, the degree of melting and fusion of the microfibers and the adhesion of the melted and fused microfibers to the staple fibers. The use of the air laid process allows uniform distribution of the bonding microfibers into the composite sheet material of the present material. As a result in the present invention, uniform composite sheet materials can be achieved at any basis weight.

Prior to the heat and pressure process, the coform web 24 is a well defined fibrous structure. The fiber structure of the microfibers and the staple fibers can be readily discerned. Such materials do not have the requisite strength, durability and tear resistance that are required in tough end use applications such as abrasive backing materials, industrial belting materials, laminate backers, and geotextiles. Their open structures and abundant pores also make such coform materials poor substrates for supporting adhesives in abrasive applications.

In contrast, it is possible to subject the coform web to so much heat and pressure that the microfibers melt completely out to form a film reinforced by the staple fibers. In this form, the material has very few or no pores and the staple fibers are completely surrounded by the solidified microfibers. As will be shown in the examples and data to follow, in this state the material is also lacking in sufficient tear resistance and strength. Once a tear has been started in such a material, the continuous nature of the film-like material seems to encourage the propagation of the tear despite the presences of the staple fibers.

Figure 5:
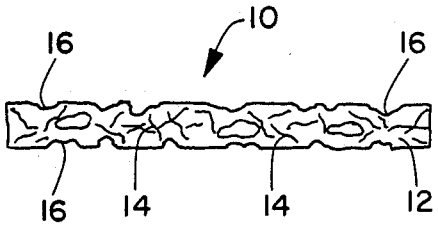
FIG. 5 is a cross-sectional side view of a composite sheet material according to the present invention.
Figure 6:
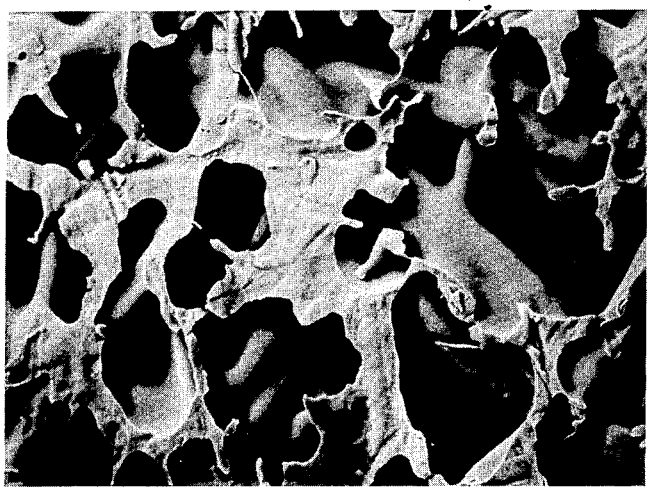
FIG. 6 is a scanning electron microscope photograph of the top surface of a composite sheet material according to the present invention.

The composite sheet material of the present invention lies between these two extremes and possesses strength, durability and tear resistance properties well above those exhibited by the materials at the two extremes. It is believed that these improved properties are due to the plurality of voids which are formed within the partially melted and fused microfibrous portion of the structure. Referring to FIGS. 5 and 6, the composite sheet material 10, which is comprised of the melted out microfibers 12 and still intact staple fibers 14, can be seen to have a plurality of voids 16 on its surface and throughout the structure. It is believed that these voids act as tear stops to help retard further tearing once a tear has begun. Typically, tears start along the edge of a material, especially in the use of abrasive belting materials. Testing has indicated that more force is needed to start a new tear than to continue the tearing action once it has been started. A case in point is the coform web which has been melted out to a film-like structure. This structure will easily continue a tear once it has been started. In contrast, the composite sheet material of the present invention has a plurality of voids dispersed throughout its structure. Every time a tear encounters one of the voids, it is akin to starting a new tear which requires more force. As a result, the tear strength of composite sheet the material is superior to that of the coform web or the coform web which has the microfibers melted out into a film-like material. Support for this proposition is found within the following examples.

EXAMPLES

Numerous staple coform webs were prepared from a number of staple and microfiber materials in a variety of microfiber to staple fiber ratios. These samples were then subjected to varying amounts of heat and pressure to melt out the microfiber portion of the web into a sheet-like material containing the staple fibers and a certain percent void volume. The samples were then subjected to slit trapezoidal tear and strip tensile tests to determine their strength.

The percent void volume for the samples was determined from the following equation and procedure:

$$\%\ \text{void volume} = \left(1 - \frac{d_T}{d_p}\right)100$$

$d_T$=the apparent density of the composite. This is determined by carefully weighing and measuring the length, width, and thickness of a rectangular piece of the composite. The apparent density is the weight in grams divided by the volume in cubic centimeters.

$d_P$=the absolute density of the composite. The absolute density is calculated from the weight fractions of the various fiber components and their respective absolute densities, i.e. the reciprocal sum of the volume fractions in cubic centimeters for one gram of composite.

It is important to note that when the thermoplastic microfibers used to form the web materials are heated, they do not melt at a specified temperature. Instead, as their temperatures increase, they begin to soften and lose their shape. As they do so, they become tacky and moldable. The fibers continue to lose their shape until finally, they join together into a contiguous sheet. As stated previously, to ensure the integrity of the staple fibers during the formation of the composite sheet material, the melting point of the staple fibers should be at least 10° C higher than the melting point of the microfibers. The melting points reported herein for the various microfibers and staple fibers were obtained from the specification sheets supplied by the resin manufacturers. These melting point values were then checked using a Fisher-Johns melting point apparatus in accordance with ASTM test method D795. All melting points were at normal atmospheric pressure.

EXAMPLE I

Meltblowing equipment similar to that described in U.S. Pat. No. 4,100,324 was used to form the meltblown adhesive microfibers of Example I. Staple fibers were added to the meltblown stream through a picker roll and secondary air system as illustrated in FIG. 1. The microfibers were formed from EASTOBOND® FA 300 polyester resin which is available from Eastman Chemical Products, Inc., of Kingsport, Tennessee, and which has a melting point of 155° C. The extruded fibers were continuous in length with diameters in the range of 2 to 10 microns and with the majority of the fibers having diameters in the 4 to 6 microns range. The staple fibers were made from KODEL® 431 polyester which is available from Eastman Chemical Products, Inc., of Kingsport, Tennessee. The polyester staple fibers were approximately 38 mm in length with a denier of 15 and a melting point of 237° C. Mixing of the microfibers to staple fibers was in a weight ratio of 30:70 and the homogeneous mixture of staple and microfibers was collected on a rotating drum to form a low density web having a basis weight of 320 grams per square meter ($g/m^2$). The web was then placed in a heated hydraulic press (PHI model 75MR-253C-Y3-C from Pasadena Hydraulics, Inc., of South Elmonte, California) at a temperature of approximately 143° C. and a pressure of $26.2\times10^6$ $N/m^2$ for a period of 4 seconds. Note that the press temperature of 143° C. was below the melting point of both the microfibers (155° C.) and the staple fibers (237° C.). By using a much higher pressure, a lower temperature can be used to melt out the microfibers while still keeping the integrity of the staple fibers intact. Thus, the staple coform web can be transformed into the composite sheet material by at least one of several ways. First, only heat can be applied to transform the material. In this case the temperature of the heat would be between the melting points of the microfibers and the staple fibers. A second method would involve using heat, again at a temperature between the melting points, and a low to moderate amount of pressure. This combination would speed up the transformation of the material, thereby decreasing the processing time. Lastly, the material can be transformed by using a high degree of pressure which will allow the temperature to be dropped even below the melting point of the microfibers. Note that with each method the exact temperature and/or pressure will depend upon the properties of the microfibers and staple fibers being used.

Figure 7:
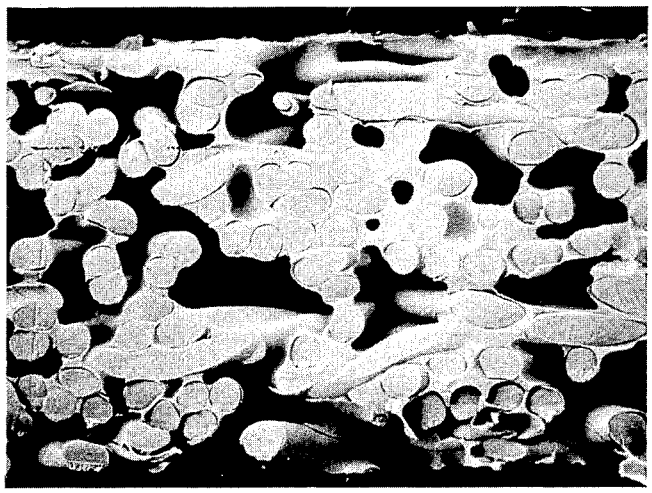
FIG. 7 is a scanning electron microscope photograph in cross-section of a composite sheet material according to the present invention.

As a result of the conditions within the press in Example I, the microfibers were melted and compressed to form an open cell-like, "honeycombed" composite structure with the melted microfibers surrounding and adhering to the staple fibers. As can be seen from the scanning electron microscope photographs of FIGS. 6 and 7, the cell-like openings or voids were uniformly distributed throughout the structure and yielded a composite sheet material with a void volume of 45 percent using the method of calculation outlined above. The sample composite of Example I had a machine direction (MD) and cross direction (CD) strip tensile strength of 45 kg/25 mm and 36 kg/25 mm respectively as calculated using TAPPI method T404-0S-61. MD and CD slit trapezoidal tear resistances were 24 kg and 10 kg respectively. In this and all other examples, the MD and CD slit trapezoidal tear resistances were calculated using ASTM test method D1117, Section 14, Part 32 modified as follows:

(a) specimen cut, 1"×6".
(b) the 1" wide base of the trapezoidal template is aligned with one 6" edge of the specimen for marking and slitting.
(c) only the maximum tensile value is reported for each specimen.
(d) machine direction refers to a propagated tear across the machine direction, i.e., as tearing in the cross direction of the web.

EXAMPLE II

A coform material of the same blend as Example I was used in Example II except that it was subject to a heat and pressure process similar to that shown in FIG. 3. A roll of the material having a basis weight of 290 $g/m^2$ was carried on a teflon coated fiberglass belt under infrared heaters to raise the web temperature to 188° C. and soften the microfibers. The web was then passed through a smooth calender with a nip pressure of 2004 kg per linear meter and a speed of 6.1 m/min. The compressed composite, while still on the teflon coated fiberglass belt, was next passed over a chill roll at 18° C. and then released from the belt. The resultant composite sheet material, as with Example I, was strong and tear resistant. The material had a void volume of 48 percent, a machine direction (MD) strip tensile strength of 36 kg/25 mm, a cross direction (CD) strip tensile strength of 29 kg/25 mm, a MD slit trapezoidal tear strength of 19 kg and a CD slit trapezoidal tear strength of 10 kg.

EXAMPLE III

Example I was repeated using DYNAPOL® S-360, a polyester adhesive resin from Dynamitt Noble America, Inc., of Rockleigh, New Jersey, in place of the EASTOBOND® FA 300 as the meltblowing microfiber resin. The melting point of the polyester adhesive resin was 200° C. The staple fiber composition, the mixing ratio, and the total basis weight were the same as in Example I. The resin for the adhesive microfibers processed well and the resultant composite was formed at 190° C. at the same pressure and for the same amount of time as used in Example I. Void volume for the composite was 34 percent, the MD and CD strip tensile strengths were 37 kg/25 mm and 28 kg/25 mm respectively and the MD and CD slit trapezoidal tear strengths were both 15 kg.

EXAMPLE IV

In Example IV numerous samples with the same staple fiber and microfiber compositions as Example I were run using varying ratios of microfibers to staple fibers. These samples were then tested for tear resistance and tensile strength to determine acceptable ratios of microfibers to staple fibers. Testing indicated that the upper and lower limits for the ratio of fibers were from 20 parts microfibers and 80 parts staple fiber to 65 parts microfibers and 35 parts staple fiber on a per weight basis. With less than 20 parts microfiber the bonding of the staple fiber was found to be inadequate. Above 65 parts microfibers there was insufficient staple fiber present to provide good tensile strength and tear resistance.

EXAMPLE V

Figure 8:
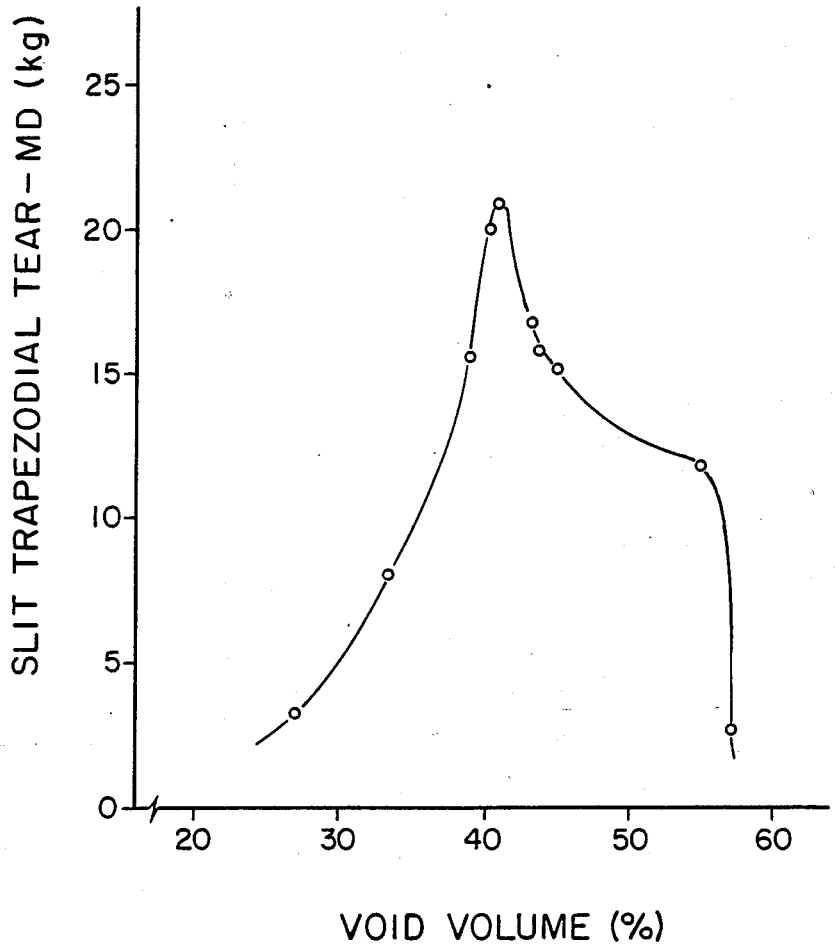
FIG. 8 is a graph illustrating the data gathered from the examples described in the application.

Having determined the proper weight ratio of microfibers to staple fibers, the purpose of Example V was to determine the appropriate range of void volumes necessary for a composite with good strength. Samples were made from the same fiber compositions as in Example I;

i.e., a basis weight of 290 g/m$^2$ with a 30/70 weight ratio of microfibers (EASTOBOND® FA 300 polyester resin) and polyester staple fibers (KODEL® 431, 15 denier, 38 mm). Void volumes in the composite sheets were varied by adjusting the bonding temperature while maintaining the pressure and time within the hydraulic press constant. Data for each of the various samples is shown in Table I and the percent void volume versus slit trapezoidal tear strength in the machine direction is shown in graph I. Note that the slit trapezoidal tear strengths given in Table I and shown in the graph of FIG. 8 are in kilograms per a basis weight of 290 grams/square meter. For uniformity, these values were converted to a 100 gram/square meter basis weight using a conversion of the ratios as follows:

$$\frac{\text{measured slit trap (kg)}}{290\ \text{g/m}^2} = \frac{\text{slit trap (kg)}}{100\ \text{g/m}^2}$$

$$\text{slip trap (kg per 100 g/m}^2) = \text{measured slit trap (kg)} \times \frac{100}{290}$$

TABLE I

| EXAMPLE # | % VOID VOLUME | SLIT TRAP. TEAR (kg.) | SLIT TRAP TEAR (kg) PER 100 g/m$^2$ | TEMP. (°C.) | PRESSURE (N/m$^2$) | TIME (SEC) |
|---|---|---|---|---|---|---|
| VA | 27 | 3.2 | 1.1 | 232 | 26.2 × 10$^6$ | 4 |
| VB | 34 | 8.2 | 2.8 | 221 | Same | Same |
| VC | 39 | 15.6 | 5.4 | 207 | Same | Same |
| VD | 40 | 20.0 | 6.9 | 193 | Same | Same |
| VE | 41 | 20.8 | 7.2 | 179 | Same | Same |
| VF | 43 | 16.7 | 5.8 | 166 | Same | Same |
| VG | 44 | 15.9 | 5.5 | 152 | Same | Same |
| VH | 45 | 15.4 | 5.3 | 138 | Same | Same |
| VI | 55 | 11.8 | 4.1 | 124 | Same | Same |
| VJ | 57 | 2.7 | 0.9 | 96 | Same | Same |

As can be seen from the data in Table I and its depiction in graph form in FIG. 8, a very dramatic increase in slit trapezoidal tear strength (MD) was achieved at select void volumes. For materials of the present design, it is desirable to have slit trapezoidal tear strengths in the machine direction which are greater than or equal to 5 kg per 290 g/m$^2$ (1.7 kg per 100 g/m$^2$). Referring to graph I, this criterion was met when the void volume was between approximately 33 and 55 percent. However, the most dramatic increase in slit trapezoidal tear strength took place when the material had a void volume between approximately 38 and 45 percent. In this range the tear strength was as high as 20.8 kg (7.2 kg per 100 g/m$^2$) which is over four times the desired base level of 5 kg (1.7 kg per 100 g/m$^2$).

In contrast to the excellent strength exhibited by materials with void volumes in the 33 to 55 percent range, materials outside this range were weak. At a low void volume the material was more like a film with very few voids and a low trapezoidal tear strength. Similarly, at high void volumes, i.e. greater than 55 percent, the material more closely resembled a nonwoven web with a very open pore structure. Here again the slit trapezoidal tear strength was low. Only when the composite sheet materials had void volumes in the range of about 33 to about 55 percent were the desired properties achieved.

EXAMPLE VI

A composite sheet material was made from a 30/70 weight ratio of polyamide microfibers (melting point 140° C.) and nylon staple fibers (melting point 247° C.). The microfibers were made using Union Camp UNIREZ® 2665 hot melt polyamide resin in meltblowing equipment similar to that described in U.S. Pat. No. 4,100,324. The microfibers were continuous in length with diameters in the 4 to 6 micron range. The staple fibers were nylon 66 from ICI Fibers of Greensboro, North Carolina, and averaged 38 mm in length with a denier of 15. The staple fibers were added to the microfibers as they were formed through a picker and secondary air stream as was previously described and illustrated in FIG. 1. The staple coform mixture was collected on a rotating drum to form a low density web having a basis weight of 320 g/m$^2$. The web was then placed in a heated hydraulic press at approximately 145° C. at a pressure of 18.6×10$^6$ N/m$^2$ for 45 seconds. The heat and pressure caused the microfibers to melt to form a void-filled layer around the staple fibers. The resultant composite sheet material had a "honeycombed" structure with open cell-like units and a void volume of 45 percent. MD and CD strip tensile strengths were 33 kg/25 mm and 22 kg/25 mm respectively while the MD and CD slit trapezoidal tear strengths were respectively 10 kg (3.2 kg per 100 g/m$^2$) and 11 kg (3.4 kg per 100 g/m$^2$).

The flexible tear resistant composite of sheet material of the present invention also proved to be an excellent material for lamination to aesthetically appealing or functional surface materials. For example, a lightweight, weak, soft leather was heat laminated to the composite sheet material of the present example. The polyamide microfibers served as the adhesive for the leather and composite sheet laminate. The resultant material was a flexible tear resistant sheet with a soft leather surface. The laminate was made in one step with process conditions as described on Example No. VI and the same physical properties. A leather book cover or table covering are but two product applications for a flexible tear-resistant composite sheet-leather laminate. The aesthetically appealing surfacing materials are not limited to leather and can include cloth, foil, cellulose, ceramic, or synthetic fabrics.

EXAMPLE VII

In addition to the previous samples, several other samples were also prepared in accordance with the methods and design parameters of the present invention. A summary of these examples is provided within Table II. A total of thirteen samples were prepared from a variety of microfibers and staple fibers with basis weights ranging from 85 to 500 g/m$^2$ and microfiber to staple weight ratios of 20/80 to 65/35. Testing of these samples confirmed that the staple fibers should be at least 10 mm in length for good strength properties in the composite. The adhesive microfibers must melt and flow at a temperature that does not destroy the intrinsic strength characteristic of the staple fibers. Therefore the melting point of the staple fibers should be at least 10° C. greater than the melting point of the microfibers.

TABLE II

| Composition No. | A | B | C | D | E | F | G | H | I | J | K | L | M | N |
|---|---|---|---|---|---|---|---|---|---|---|---|---|---|---|
| Basis Weight (g/m$^2$) | 100 | 85 | 350 | 320 | 250 | 275 | 450 | 300 | 275 | 500 | 200 | 450 | 400 | 300 |
| Parts Adhesive Microfiber | | | | | | | | | | | | | | |
| Polyethylene (Dow 618) | 40 | | | | | | | | | 30 | | | | |
| Polyester PBT (Valox ® 315) | | 20 | 50 | | | | | | | | | | | 30 |
| Polyester (EASTBOND ® FA300) | | | | 30 | | | | | | | | 30 | | |
| Polyester (DYNAPOL ®'S 360) | | | | | 65 | | | | | | | | | |
| Polyamide (UNIREZ ® 2665) | | | | | | 30 | | | | | 35 | | | |
| Polyurethane (ESTANE ® 58887) | | | | | | | 40 | 30 | 20 | | | | | |
| Polyethylene Vinylacetate (ESCORETENE ® Ultra) | | | | | | | | | | | | | | |
| Parts Staple Fiber | | | | | | | | | | | | | | |
| Polyester PET, 6 Denier, 25 mm | | 80 | | 35 | | | | | | 70 | | | 60 | 15 |
| Polyester PET, 15 Denier, 50 mm | | | | 35 | 35 | | | 35 | | | | 35 | | |
| Nylon, 6, 3 Denier, 38 mm | | | | | | 35 | 30 | | | | | | | |
| Nylon, 6, 25 Denier, 75 mm | | | | | | 35 | | 35 | 80 | | | | | |
| Nylon 66, 30 Denier, 50 mm | | | 50 | | | | | | | | | | | |
| Rayon, 15 Denier, 38 mm | 60 | | | | | | 30 | | | | | | | |
| Acrylic, 15 Denier, 10 mm | | | | | | | | | | | 65 | | | |
| 'C' Glass, 30 Denier, 100 mm | | | | | | | | | | | | 35 | | |
| Aromatic polyamide Kevlar ®, 12 mm | | | | | | | | | | | | | | 55 |

Having thus described the invention in detail, it should be apparent to those skilled in the art that various modifications and changes can be made without departing from the spirit and scope of the following claims.

What is claimed is:

1. A flexible tear resistant composite sheet material comprising:

a layer of melted and partially fused thermoplastic microfibers having a plurality of intact staple fibers having an average diameter less than or equal to 10 microns homogeneously dispersed throughout said layer, said staple fibers having an average length ranging from about 10 mm to 100 mm and a denier from about 3 to about 30, said staple fibers being present in said layer in a weight ratio of staple fibers to microfibers ranging from 80:20 to 35:65, said staple fibers further having a melting point at least 10° C. greater than said microfibers, said composite having a plurality of voids dispersed therein such that said composite has a percent void volume of about 33 to about {percent and a slit trapezoidal tear resistance greater than or equal to 1.7 kg per 100 g/m$^2$ equivalent basis weight as measured in the machine direction.

2. The flexible tear resistant sheet material of claim 1 wherein said thermoplastic microfibers are formed from a material selected from the group consisting of polyamides, polyesters, polyurethanes, polyvinyl acetates, polyolefins and compatible copolymers thereof.

3. The flexible tear resistant sheet material of claim 2 wherein said staple fibers are formed from a material selected from the group consisting of nylon, polyester, rayon, acrylic, glass and aromatic polyamides, said staple fibers being adhesively compatible with said thermoplastic microfibers.

4. A flexible tear resistant composite sheet material comprising a web of thermoplastic microfibers having a average diameter less than or equal to 10 microns with a plurality of staple fibers homogeneously dispersed throughout said web to form said composite, said staple fibers having an average length ranging from about 10 mm to 100 mm and a denier from about 3 to about 30, said staple fibers being present in said microfibrous web in a weight ratio of staple fibers to microfibers ranging from 80:20 to 35:65, said staple fibers further having a melting point at least 10° C. greater than said thermoplastic microfibers, said composite being subjected to a sufficient quantity of heat and pressure such that said thermoplastic microfibers melt and compact into a sheet with said staple fibers being dispersed therein, said sheet having a plurality of voids to act as tear stops with a percent void volume of 33 to 55 percent and a slit trapezoidal tear resistance greater than or equal to 1.7 kg per 100 g/m$^2$ equivalent basis weight as measured in the machine direction.

5. The flexible tear resistant sheet material of claim 4 wherein said thermoplastic microfibers are formed from a material selected from the group consisting of polyamides, polyesters, polyurethanes, polyvinyl acetates, polyolefins and compatible copolymers thereof.

6. The flexible tear resistant sheet material of claim 5 wherein said staple fibers are formed from a material selected from the group consisting of nylon, polyester, rayon, acrylic, cotton, glass and aromatic polyamides, said staple fibers being adhesively compatible with said thermoplastic microfibers.

* * * * *

UNITED STATES PATENT AND TRADEMARK OFFICE

CERTIFICATE OF CORRECTION

PATENT NO. : 4,894,280

DATED : January 16, 1990

INVENTOR(S) : David W. Guthrie, et al.,

It is certified that error appears in the above-identified patent and that said Letters Patent is hereby corrected as shown below:

The title page showing the illustrative figure should be deleted to appear as per attached title page.

United States Patent [19]

Guthrie et al.

[11] Patent Number: 4,894,280

[45] Date of Patent: Jan. 16, 1990

[54] FLEXIBLE, TEAR RESISTANT COMPOSITE SHEET MATERIAL AND A METHOD FOR PRODUCING THE SAME

[75] Inventors: David W. Guthrie, Roswell; Robert E. Weber, Marietta, both of Ga.

[73] Assignee: Kimberly-Clark Corporation, Neenah, Wis.

[21] Appl. No.: 136,235

[22] Filed: Dec. 21, 1987

[51] Int. Cl.[4] ..... B32B 3/00

[52] U.S. Cl. ..... 428/224; 428/288; 428/296; 428/297; 428/903

[58] Field of Search ..... 428/224, 288, 903, 296, 428/297; 156/308.2

[56] References Cited

U.S. PATENT DOCUMENTS

| | | | |
|---|---|---|---|
| 2,399,260 | 4/1946 | Taylor | 428/903 |
| 3,016,599 | 1/1962 | Perry, Jr. | 428/903 |
| 3,620,892 | 11/1971 | Wincklhofer et al. | 161/89 |
| 3,630,818 | 12/1971 | Dobe | 161/150 |
| 3,639,195 | 2/1972 | Sanders | 156/62.2 |
| 3,704,198 | 11/1972 | Prentice | 161/148 |
| 3,916,447 | 11/1975 | Thompson | 2/46 |
| 4,041,203 | 8/1977 | Brock et al. | 428/903 |
| 4,100,324 | 7/1978 | Anderson et al. | 428/288 |
| 4,118,531 | 10/1978 | Hauser | 428/224 |
| 4,279,979 | 7/1981 | Benson et al. | 429/254 |
| 4,310,594 | 1/1982 | Yamazaki et al. | 428/296 |
| 4,315,048 | 2/1982 | Beghelli et al. | 428/78 |
| 4,426,417 | 1/1984 | Meitner et al. | 428/903 |
| 4,472,229 | 9/1984 | Martin | 156/307.1 |
| 4,474,846 | 10/1984 | Doerer et al. | 428/288 |
| 4,477,516 | 10/1984 | Sugihara et al. | 428/296 |
| 4,479,999 | 10/1984 | Buckley et al. | 428/245 |
| 4,522,863 | 6/1985 | Keck et al. | 428/196 |
| 4,555,811 | 12/1985 | Shimalla | 2/51 |
| 4,587,154 | 5/1986 | Hotchkiss et al. | 428/195 |
| 4,637,949 | 1/1987 | Manning et al. | 428/110 |

*Primary Examiner*—Paul J. Thibodeau

*Attorney, Agent, or Firm*—Patrick C. Wilson

[57] ABSTRACT

A flexible tear resistance composite sheet material is disclosed comprising a web of thermoplastic microfibers with from 35 to 80 percent by weight of staple fibers homogeneously dispersed throughout the web. The composite is subjected to a sufficient quantity of heat and pressure such that the thermoplastic microfibers at least partially melt and compact into a contiguous sheet with the intact staple fibers being dispersed therein. Located throughout the sheet are a plurality of voids which act as tear stops. The resulting material has a void volume of about 33 to about 55 percent and a machine direction slit trapezoidal tear resistance greater than or equal to 1.7 kg per 100 g/m$^2$ equivalent basis weight. Also disclosed herein is a process for making the composite sheet material.

6 Claims, 4 Drawing Sheets

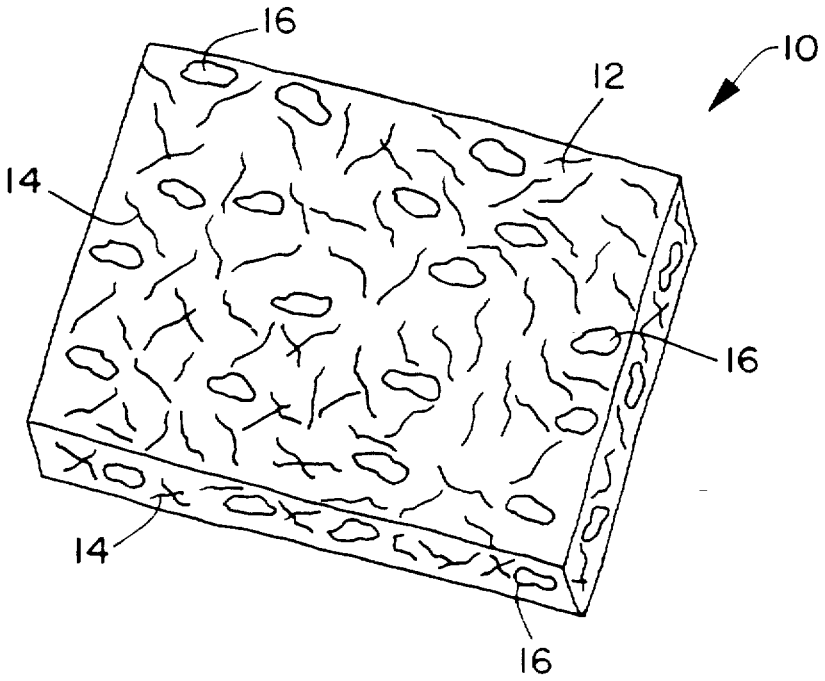

UNITED STATES PATENT AND TRADEMARK OFFICE
CERTIFICATE OF CORRECTION

PATENT NO. : 4,894,280

DATED : January 16, 1990

INVENTOR(S) : David W. Guthrie and Robert E. Weber

It is certified that error appears in the above—identified patent and that said Letters Patent is hereby corrected as shown below:

Column 3, line 49 "produce" should read --product--

Column 5, line 49 "in" should read --is--

Column 9, line 14 "microns" should read --micron--

Column 14, Table II, in the heading entitled Polyethylene Vinylacetate insert under column M the number --40--

Column 13, line 46 "(" should read --55--

Signed and Sealed this

Twelfth Day of February, 1991

*Attest:*

HARRY F. MANBECK, JR.

*Attesting Officer*

*Commissioner of Patents and Trademarks*